US010891911B2

(12) United States Patent
Zhang

(10) Patent No.: US 10,891,911 B2
(45) Date of Patent: Jan. 12, 2021

(54) MURA COMPENSATION METHOD AND MURA COMPENSATION SYSTEM FOR ADDRESSING PROBLEM OF INABILITY TO EFFECTIVELY ELIMINATE MURA AT BRIGHT OR DARK BOUNDARY LINES AFTER COMPENSATION

(71) Applicant: Shenzhen China Star Optoelectronics Semiconductor Display Technology Co., Ltd., Shenzhen (CN)

(72) Inventor: Hua Zhang, Shenzhen (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 206 days.

(21) Appl. No.: 16/308,806

(22) PCT Filed: Sep. 27, 2018

(86) PCT No.: PCT/CN2018/107816
§ 371 (c)(1),
(2) Date: Dec. 10, 2018

(87) PCT Pub. No.: WO2020/019487
PCT Pub. Date: Jan. 30, 2020

(65) Prior Publication Data

US 2020/0320944 A1 Oct. 8, 2020

(30) Foreign Application Priority Data

Jul. 24, 2018 (CN) ..... 2018 1 0821080

(51) Int. Cl.
*G09G 3/36* (2006.01)
*G09G 5/10* (2006.01)

(52) U.S. Cl.
CPC ..... *G09G 3/3648* (2013.01); *G09G 5/10* (2013.01); *G09G 2320/0233* (2013.01)

(58) Field of Classification Search
CPC . G09G 3/3648; G09G 5/10; G09G 2320/0233
See application file for complete search history.

(56) References Cited

U.S. PATENT DOCUMENTS

2015/0206276 A1* 7/2015 Jung ..... G09G 5/00 345/561
2017/0193928 A1* 7/2017 Deng ..... G09G 3/20
(Continued)

FOREIGN PATENT DOCUMENTS

CN 106898286 A 6/2017
CN 106952627 A 7/2017

*Primary Examiner* — Kwang-Su Yang
(74) *Attorney, Agent, or Firm* — Leong C. Lei

(57) ABSTRACT

The invention provides a mura compensation method and system. The method comprises: Step 10: defining a position of a bright/dark boundary line as a first area, and defining an area outside the first area as a second area; Step 20: using a pixel as a unit to directly query each pixel in the first area in a preset first mura compensation data lookup table to obtain a corresponding first mura compensation data; and using a preset block as a unit to directly query each pixel in the second area in a preset second mura compensation data lookup table and calculate to obtain a corresponding second mura compensation data; Step 30: for pixels in first area, performing mura compensation on each pixel according to the corresponding first mura compensation data, and for pixels in second area, performing mura on each pixel according to the corresponding first mura compensation data.

3 Claims, 5 Drawing Sheets

(56) References Cited

U.S. PATENT DOCUMENTS

| | | | | |
|---|---|---|---|---|
| 2019/0197935 | A1* | 6/2019 | Kim | G09G 3/20 |
| 2020/0013326 | A1* | 1/2020 | Zheng | G09G 3/20 |

* cited by examiner

MURA COMPENSATION METHOD AND MURA COMPENSATION SYSTEM FOR ADDRESSING PROBLEM OF INABILITY TO EFFECTIVELY ELIMINATE MURA AT BRIGHT OR DARK BOUNDARY LINES AFTER COMPENSATION

BACKGROUND OF THE INVENTION

1. Field of the Invention

The present invention relates to the field of display, and in particular to a mura compensation method and mura compensation system.

2. The Related Arts

Due to the limitation of manufacturing facility, the panel often has a large area of uneven brightness (mura), and the boundary line is 1 or 2 pixel wide in the vertical or horizontal direction, with brightness difference between the two sides. FIG. 1 shows a schematic view of a large-area block mura appearing on a large-size LCD panel having a vertical light-dark boundary line on the panel.

The known mura repair system generally comprises two parts: the mura compensation data acquisition device and the timing controller (TCON IC). The brightness can be changed by adjusting the grayscale compensation value (voltage) of the pixel to repair the mura to make the brightness uniform.

FIG. 2 shows a schematic view of the original mura and De-mura compensation data of the panel. In the case where the input image is a single grayscale image (theoretically all the pixels having the same brightness), the original mura is compensated by the De-mura compensation data. According to the brightness at the central area of the panel, a certain grayscale compensation value (to increase brightness) is added to the pixels of the dark area (the right side of the panel), and a certain grayscale compensation value (to reduce brightness) is reduced for the pixels of the bright area (the left side of the panel).

FIG. 3 shows a schematic view of a method for calculating the compensation data for uneven brightness in the prior art. The number of pixels on the LCD panel is huge. The existing mura repair system performs mura compensation in units of blocks, for example, a block containing 8*8=64 pixels, and pre-stores the compensation data A, B, C, D for uneven brightness for the four vertices of the block. When performing mura compensation, the compensation data for uneven brightness of the remaining pixels in the block, such as E, F, G, can be calculated by linear interpolation with the compensation data A, B, C, D for uneven brightness for the four vertices of the block.

FIG. 4 shows a schematic view of the brightness difference after compensating for the pixels at the position of the bright/dark boundary line in the prior art. The upper part of FIG. 4 shows the bright/dark boundary of the mura on the panel, and the square blocks located at the bright/dark boundary when performing mura compensation based on the block according to the prior art. The lower part of FIG. 4 shows a position-brightness coordinate system, wherein the horizontal axis corresponds to the lateral position of the panel, the vertical axis corresponds to the brightness of the pixel, the brightness of the panel center is used as the brightness compensation standard of the pixel, and the brightness compensation effect of the pixel at the lower edge of the block is shown. The two horizontal line segments in the position-brightness coordinate system represent the brightness of the pixels on both sides of the bright/dark boundary line; the end point of the slant line segment below the horizontal axis indicates the compensated brightness at the vertices of the block, and the slant line segments indicate the compensated brightness of the pixels between the vertex pixels calculated by the linear interpolation method; the curve near the horizontal axis represents the actual compensated brightness of the pixels on both sides of the bright/dark boundary line, which can be obtained by integrating the horizontal line segment and the slant line segment; the ideal compensated brightness of the pixels on both sides of the bright/dark boundary line is the line segment that coincides with the horizontal axis. That is, the ideal compensation result should be compensated to the center brightness of the panel. In FIG. 4, the width of the mura area on both sides of the bright/dark boundary line of the panel is less than 8 pixels. The mura compensation data calculated by the linear interpolation method cannot accurately correspond to the mura at the position of the bright/dark boundary line. The linear interpolation method is the most effective approach to be used to compensate the pixels at the position of the bright/dark boundary line. As a result, there is still brightness difference between two sides of the bright/dark boundary lines after the compensation.

SUMMARY OF THE INVENTION

The object of the present invention is to provide a mura compensation method and mura compensation system, able to address the problem of inability to effectively eliminate the mura at the bright/dark boundary line on the display panel.

To achieve the above object, the present invention provides a mura compensation method, which comprises:

Step 10: defining a position of a bright/dark boundary line in a display panel as a first area, and defining an area outside the first area in the display panel as a second area;

Step 20: using a pixel as a unit to directly query each pixel in the first area in a preset first mura compensation data lookup table to obtain a first mura compensation data corresponding to each pixel; and using a preset block as a unit to directly query each pixel in the second area in a preset second mura compensation data lookup table and calculate to obtain a second mura compensation data corresponding to each pixel;

Step 30: for pixels in the first area, performing mura compensation on each pixel according to the corresponding first mura compensation data, and for pixels in the second area, performing mura on each pixel according to the corresponding first mura compensation data.

Wherein, the step of using a preset block as a unit to directly query each pixel in the second area in a preset second mura compensation data lookup table and calculate to obtain a second mura compensation data corresponding to each pixel comprises:

for each pixel, determining a block in which the pixel is located;

querying, in the second mura compensation data lookup table, the second mura compensation data corresponding to pixels of each vertex of the block;

for the pixel being located at a vertex of the block, the second mura compensation data corresponding to the pixel being determined from the second mura compensation data corresponding to the pixels of each vertex of the block; for the pixel being located at other positions of the block, the second mura compensation data corresponding to the pixel being calculated by linear interpolation according to the second mura compensation data corresponding to the pixels of the vertices of the block.

Wherein, the preset first mura compensation data lookup table is formed by the following steps:

performing mura compensation data acquisition for each pixel in the first area using a pixel as a unit, and obtaining the first mura compensation data corresponding to each pixel in the first area;

storing location information of each pixel in the first area and the corresponding first mura compensation data in the first mura compensation data lookup table.

Wherein, the preset second mura compensation data lookup table is formed by the following steps:

performing mura compensation data acquisition for pixels in the first area using a block as a unit, and obtaining the second mura compensation data corresponding to the pixels of each vertex of each block in the second area;

storing location information of the pixels of each vertex of each block in the second area and the corresponding second mura compensation data in the second mura compensation data lookup table.

The present invention also provides a mura compensation system, which comprises:

an area-defining module, for defining a position of a bright/dark boundary line in a display panel as a first area, and defining an area outside the first area in the display panel as a second area;

a compensation data acquisition module, for using a pixel as a unit to directly query each pixel in the first area in a preset first mura compensation data lookup table to obtain a first mura compensation data corresponding to each pixel; and using a preset block as a unit to directly query each pixel in the second area in a preset second mura compensation data lookup table and calculate to obtain a second mura compensation data corresponding to each pixel;

a compensation module, for pixels in the first area, performing mura compensation on each pixel according to the corresponding first mura compensation data, and for pixels in the second area, performing mura on each pixel according to the corresponding first mura compensation data.

Wherein, the compensation data acquisition module performs the step of using a preset block as a unit to directly query each pixel in the second area in a preset second mura compensation data lookup table and calculate to obtain a second mura compensation data corresponding to each pixel, comprising:

for each pixel, determining a block in which the pixel is located;

querying, in the second mura compensation data lookup table, the second mura compensation data corresponding to pixels of each vertex of the block;

for the pixel being located at a vertex of the block, the second mura compensation data corresponding to the pixel being determined from the second mura compensation data corresponding to the pixels of each vertex of the block; for the pixel being located at other positions of the block, the second mura compensation data corresponding to the pixel being calculated by linear interpolation according to the second mura compensation data corresponding to the pixels of the vertices of the block.

Wherein, the preset first mura compensation data lookup table is formed by the following steps:

performing mura compensation data acquisition for each pixel in the first area using a pixel as a unit, and obtaining the first mura compensation data corresponding to each pixel in the first area;

storing location information of each pixel in the first area and the corresponding first mura compensation data in the first mura compensation data lookup table.

Wherein, the preset second mura compensation data lookup table is formed by the following steps:

performing mura compensation data acquisition for pixels in the first area using a block as a unit, and obtaining the second mura compensation data corresponding to the pixels of each vertex of each block in the second area;

storing location information of the pixels of each vertex of each block in the second area and the corresponding second mura compensation data in the second mura compensation data lookup table.

In summary, the mura compensation method and mura compensation system of the present invention can improve the mura repair effect of the bright/dark boundary areas on the LCD panel.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 5:
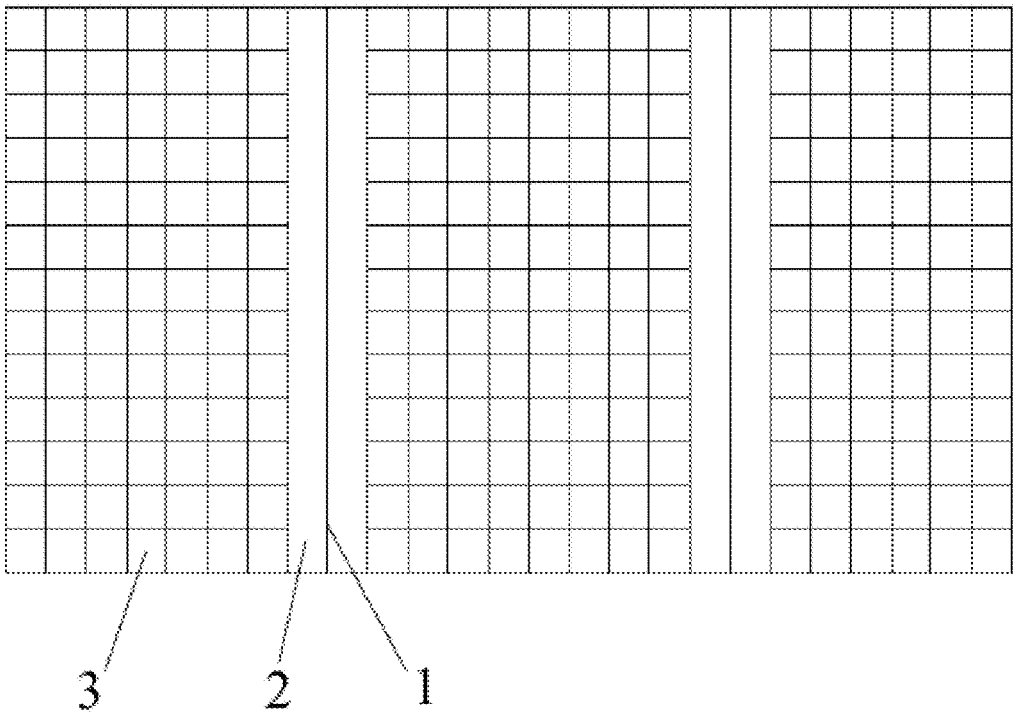
FIG. 5 is a schematic view showing the definition of area of a preferred embodiment of the mura compensation method of the present invention.
Figure 7:
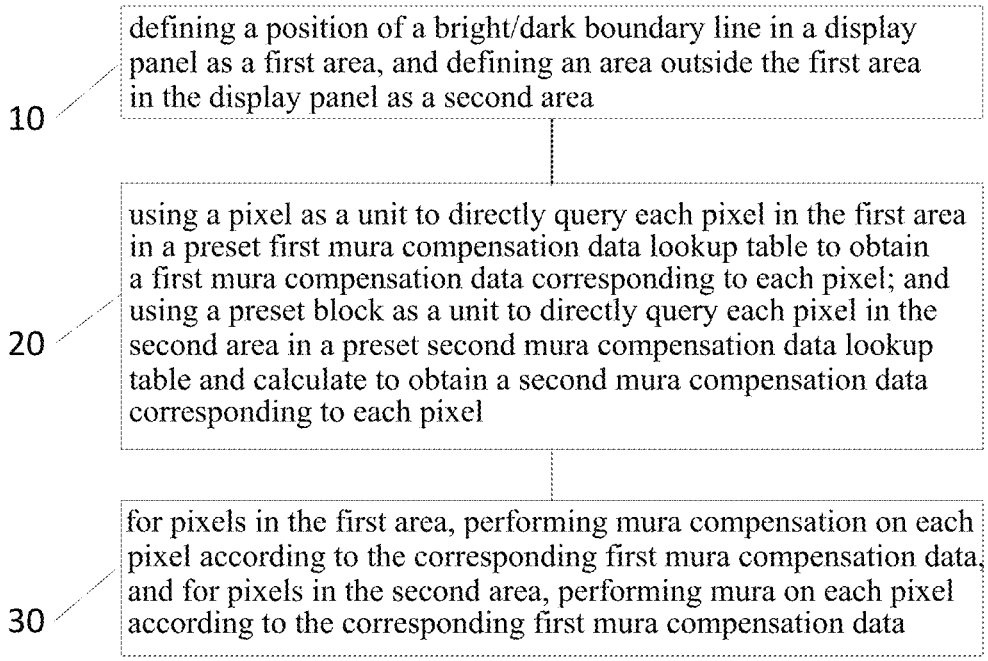
FIG. 7 is a schematic view showing the flowchart of the mura compensation method of the present invention.

Refer to FIG. 7, the mura compensation method of the present invention comprises the following steps:

Step 10: defining a position of a bright/dark boundary line in a display panel as a first area, and defining an area outside the first area in the display panel as a second area. Specifically, refer to FIG. 5. FIG. 5 is a schematic view showing the definition of area of a preferred embodiment of the mura compensation method of the present invention. The present invention defines the position of the bright/dark boundary line 1 in the vertical direction of the display panel as the first area 2, that is, the area wherein the pixels are processed individually, and the position/width of the first area 2 can be defined according to the actual situation. The other area without bright/dark boundary line is defined to the second area 3. When there are a plurality of bright/dark boundary lines 1 on the display panel, the corresponding first area 2 can be defined for each of the bright/dark boundary lines 1 respectively. The location information of the pixels in the first area 2 may be pre-stored in the first mura compensation data lookup table; the location information of the blocks in the second area 3 may be pre-stored in the second mura compensation data lookup table. For example, the location information of the block in FIG. 3 can be represented by the location of the pixel of each vertex of the block, and once the location information of the pixels of each vertex of the block is determined, the location information of the block is determined.

Step 20: using a pixel as a unit to directly query each pixel in the first area in a preset first mura compensation data lookup table to obtain a first mura compensation data corresponding to each pixel; and using a preset block as a unit to directly query each pixel in the second area in a preset second mura compensation data lookup table and calculate to obtain a second mura compensation data corresponding to each pixel.

When performing mura compensation on the pixel to be compensated, the first step is to determine the pixel is in the first area or the second area according to the position information of the pixel to be compensated.

Since the location information of the pixels in the first area is pre-stored in the first mura compensation data lookup table, a direct query to the preset first mura compensation data lookup table can obtain the corresponding first mura compensation data for the pixels to be compensated in the first area according to the location thereof.

For the pixels to be compensated in the second area, the block in which the pixel is located is determined according to the location thereof, and a direct query using a preset block as a unit to the preset second mura compensation data lookup table can obtain the corresponding second mura compensation data for the pixels of the vertices of the block. Then, the corresponding second mura compensation data is further determined according to the specific location of the pixel to be compensated in the block. If the pixel to be compensated is located at a vertex of the block, the second mura compensation data corresponding to the pixel to be compensated is determined from the second mura compensation data corresponding to the pixels of each vertex of the block; if the pixel to be compensated is located at other positions of the block, the second mura compensation data corresponding to the pixel to be compensated is calculated by linear interpolation according to the second mura compensation data corresponding to the pixels of the vertices of the block.

Figure 1:
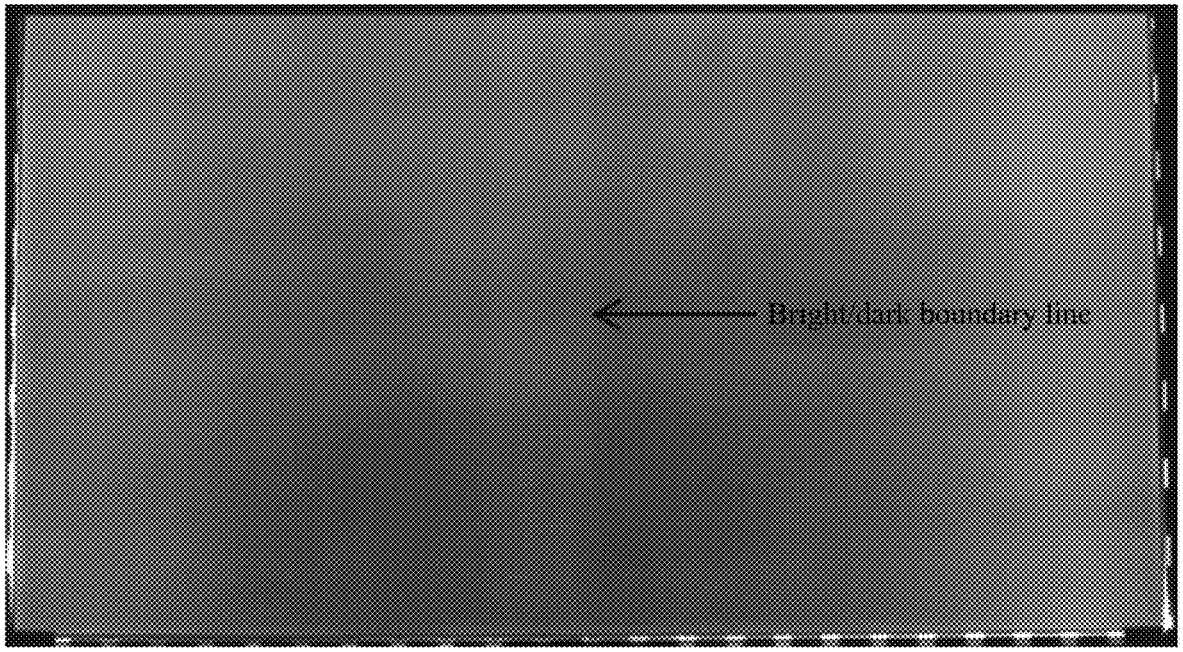
Fig. 1 PRIOR ART
FIG. 1 is a schematic view showing a large-area block mura appearing on a large-size LCD panel having a vertical light-dark boundary line on the panel.
Figure 2:
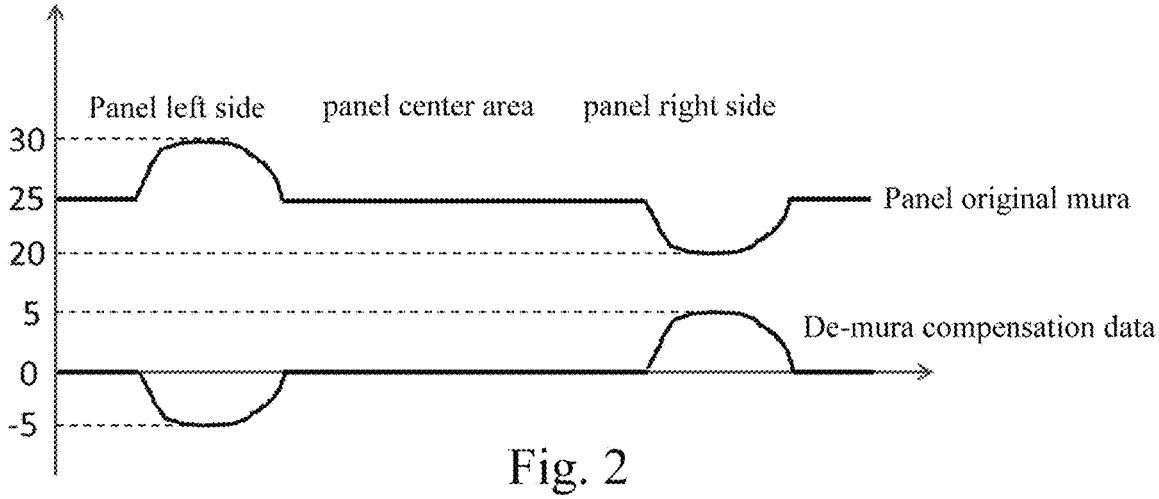
Fig. 2 PRIOR ART
FIG. 2 is a schematic view showing the original mura and De-mura compensation data of the panel.
Figure 3:
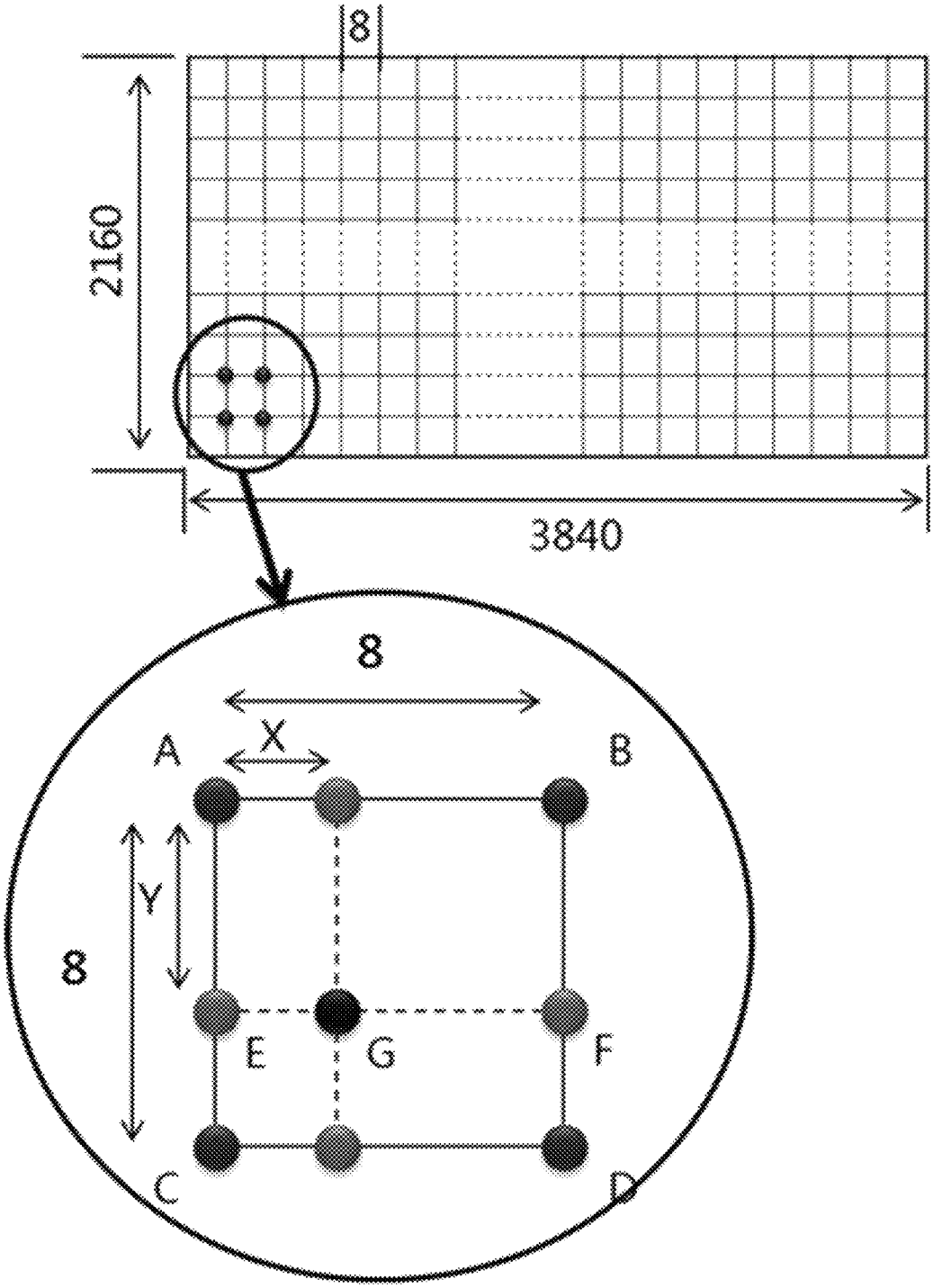
Fig. 3 PRIOR ART
FIG. 3 is a schematic view showing a method for calculating the compensation data for uneven brightness in the prior art.
Figure 4:
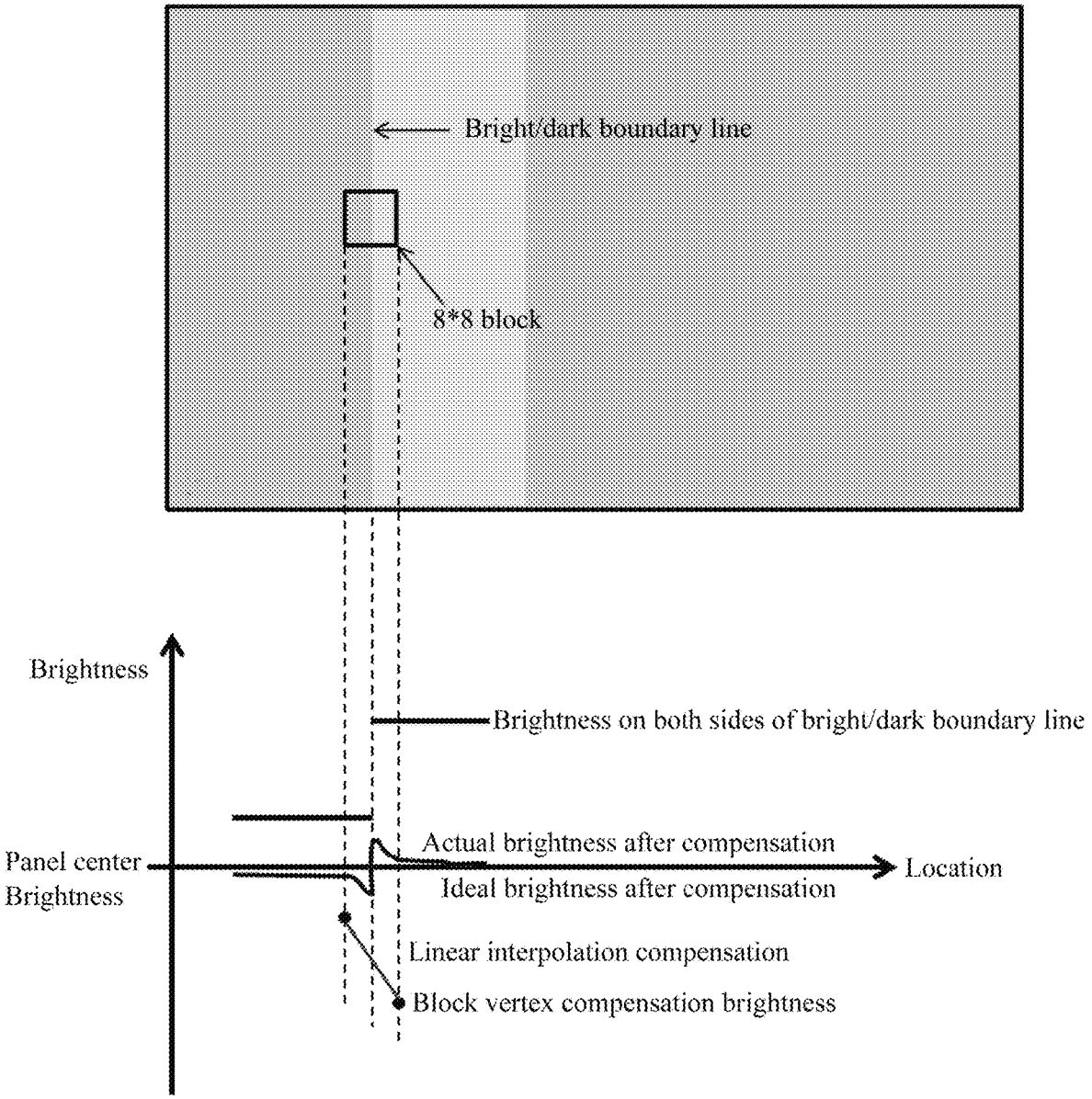
Fig. 4 PRIOR ART
FIG. 4 is a schematic view showing the brightness difference after compensating for the pixels at the position of the bright/dark boundary line in the prior art.

Refer to FIG. 3 for the specific linear interpolation calculation method. Taking a block including 8*8=64 pixels as an example, the second mura compensation data lookup table pre-stores the uneven brightness compensation data A, B, C, D of the pixels of each vertex of the block. When performing mura compensation, the uneven brightness compensation data of the pixels of the vertex of the block can be directly read from the second mura compensation data lookup table. The uneven brightness compensation data, such as E, F, G, for the remaining pixels in the block can be linearly interpolated from the uneven brightness compensation data A, B, C, D of pixels of the four vertices of the block according to the specific location of the remaining pixels in the block. The calculation formula is as follows:

$$E=[(8-Y)]*A+Y*C]/8;$$

$$F=[(8-Y)]*B+Y*D]/8;$$

$$G=[(8-X)]*E+X*F]/8;$$

where X and Y indicate the relative positions of the remaining pixels within the block.

The preset first mura compensation data lookup table is formed by the following steps: performing mura compensation data acquisition for each pixel in the first area using a pixel as a unit, and obtaining the first mura compensation data corresponding to each pixel in the first area; storing location information of each pixel in the first area and the corresponding first mura compensation data in the first mura compensation data lookup table.

The preset second mura compensation data lookup table is formed by the following steps: performing mura compensation data acquisition for pixels in the first area using a block as a unit, and obtaining the second mura compensation data corresponding to the pixels of each vertex of each block in the second area; storing location information of the pixels of each vertex of each block in the second area and the corresponding second mura compensation data in the second mura compensation data lookup table.

To achieve the object of the present invention, a mura compensation data acquisition device needs to be redesigned to provide corresponding functions to obtain the first mura compensation data lookup table and the second mura compensation data lookup table of the present invention. The mura compensation data acquisition device originally sets the entire display area of the display panel using the block as a unit to obtain the uneven brightness compensation data for the pixels of the vertices of the block, and the original design is changed to partially set an area of the display panel to use a pixel as a unit to perform the first mura compensation data acquisition, so that the accurate compensation value of each pixel in the that area can be obtained. Thereby, the first mura compensation data acquisition is performed using a pixel as a unit for each pixel in the first area to obtain the first mura compensation data lookup table; and acquiring the second mura compensation data by using the preset block as the unit for the pixels in the second area, obtaining the compensation value of the pixels of the vertices of the block, and finally obtaining the second mura compensation data lookup table. The first mura compensation data lookup table and the second mura compensation data lookup table may further be stored in the flash memory.

Step 30: for pixels in the first area, performing mura compensation on each pixel according to the corresponding first mura compensation data, and for pixels in the second area, performing mura on each pixel according to the corresponding first mura compensation data.

Based on step 20 and step 30, to achieve the object of the present invention, the timing controller needs to be redesigned to incorporate corresponding functions. Originally, the mura compensation data for the pixels in the block is roughly calculated by the timing controller through linear interpolation. The redesign of the timing controller can set an area wherein the mura compensation data is based on a pixel as a unit. When performing mura compensation, for the pixels in the first area, the first mura compensation data corresponding to the pixel is obtained using a pixel as a unit. For the pixels in the second area, the second mura compensation data corresponding to the pixel is obtained by linear interpolation according to the second mura compensation data of the pixels of the vertices of the block in which the pixel is located.

When performing mura compensation, the timing controller may obtain a first mura compensation data lookup table and a second mura compensation data lookup table stored in the flash memory. The first mura compensation data lookup table comprises the corresponding first mura compensation data and the location information of the pixels in the first area, and the second mura compensation data lookup table comprises the corresponding second mura compensation data and location information of the pixels in the second area. For the pixels to be compensated in the first area, the timing controller superimposes the corresponding first mura compensation data with the corresponding original input data, obtain the most accurate mura compensation data for the pixels in the area where the bright/dark boundary line is located; for the pixels to be compensated in the second area, the timing controller still performs linear interpolation calculation according to the second mura compensation data of the pixels of the vertices of the block in which the pixel to be compensated is located, using the known second mura compensation data of the pixels of each vertex to obtain the second mura compensation data of the pixel to be compensated by linear interpolation, and then superimposing with the corresponding original input data.

Figure 6:
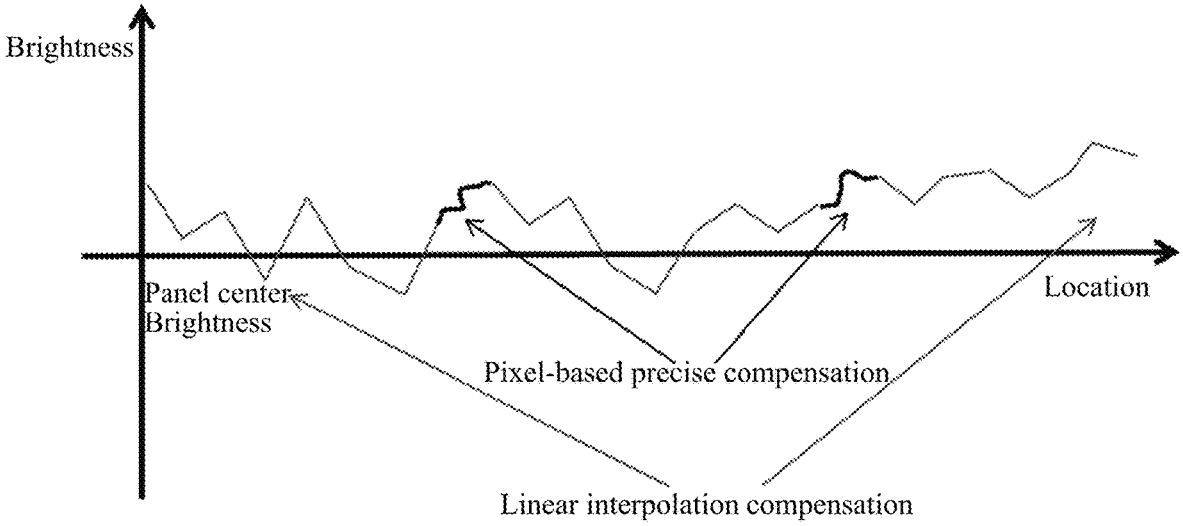
FIG. 6 is a schematic view showing the compensation result of a preferred embodiment of the mura compensation method of the present invention.

Refer to FIG. 6. FIG. 6 is a schematic view showing the compensation result of a preferred embodiment of the mura compensation method of the present invention. Also referring to FIG. 5, in the position-brightness coordinate system shown in FIG. 6, the horizontal axis corresponds to the lateral position of the panel, the vertical axis corresponds to the brightness of the pixel, and the brightness of the panel center is used as the brightness compensation standard of the pixels. For the first area of the panel, a single pixel based precise compensation approach is adopted, and for the second area of the panel, linear interpolation is used for compensation. The present invention is directed to the extremely thin bright/dark boundary lines (horizontal or vertical) mura on the display panel, where the mura compensation is no longer performed by the linear interpolation method, but using a pixel as a unit for compensation, to achieve accurate compensation of each pixel near the bright/dark boundary line and achieve the effect of eliminating the bright/dark boundary lines.

Base on the mura compensation method of the present invention, the present invention also provides a mura compensation system, which comprises:

an area-defining module, for defining a position of a bright/dark boundary line in a display panel as a first area, and defining an area outside the first area in the display panel as a second area;

a compensation data acquisition module, for using a pixel as a unit to directly query each pixel in the first area in a preset first mura compensation data lookup table to obtain a first mura compensation data corresponding to each pixel; and using a preset block as a unit to directly query each pixel in the second area in a preset second mura compensation data lookup table and calculate to obtain a second mura compensation data corresponding to each pixel;

a compensation module, for pixels in the first area, performing mura compensation on each pixel according to the corresponding first mura compensation data, and for pixels in the second area, performing mura on each pixel according to the corresponding first mura compensation data.

In summary, the mura compensation method and mura compensation system of the present invention can improve the mura repair effect of the bright/dark boundary areas on the LCD panel.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A mura compensation method, comprising:

defining a position of a bright/dark boundary line in a display panel as a first area, and defining an area outside the first area in the display panel as a second area;

using a pixel as a unit to directly query each pixel in the first area in a preset first mura compensation data lookup table to obtain a first mura compensation data corresponding to each pixel; and using a preset block as a unit to directly query each pixel in the second area in a preset second mura compensation data lookup table and calculate to obtain a second mura compensation data corresponding to each pixel; and for pixels in the first area, performing mura compensation on each pixel according to the corresponding first mura compensation data, and for pixels in the second area, performing mura on each pixel according to the corresponding first mura compensation data, wherein the preset second mura compensation data lookup table is formed by the following steps:

performing mura compensation data acquisition for pixels in the first area using a block as a unit, and obtaining the second mura compensation data corresponding to the pixels of each vertex of each block in the second area; and storing location information of the pixels of each vertex of each block in the second area and the corresponding second mura compensation data in the second mura compensation data lookup table.

2. The mura compensation method as claimed in claim 1, wherein the step of using a preset block as a unit to directly query each pixel in the second area in a preset second mura compensation data lookup table and calculate to obtain a second mura compensation data corresponding to each pixel comprises:

for each pixel, determining a block in which the pixel is located;

querying, in the second mura compensation data lookup table, the second mura compensation data corresponding to pixels of each vertex of the block;

for the pixel being located at a vertex of the block, determining the second mura compensation data corresponding to the pixel from the second mura compensation data corresponding to the pixels of each vertex of the block; and for the pixel being located at other positions of the block, calculating the second mura compensation data corresponding to the pixel by linear interpolation according to the second mura compensation data corresponding to the pixels of the vertices of the block.

3. The mura compensation method as claimed in claim 1, wherein the preset first mura compensation data lookup table is formed by the following steps:

performing mura compensation data acquisition for each pixel in the first area using a pixel as a unit, and obtaining the first mura compensation data corresponding to each pixel in the first area; and storing location information of each pixel in the first area and the corresponding first mura compensation data in the first mura compensation data lookup table.

* * * * *